United States Patent [19]

Shini et al.

[11] Patent Number: 4,975,332

[45] Date of Patent: Dec. 4, 1990

[54] RECORDING MEDIUM FOR ELECTROTHERMAL TRANSFER PRINTING

[75] Inventors: Masami Shini, Takatsuki; Masao Matsumoto, Toyonaka; Akio Shimomine, Suita; Atsuo Saiki, Settsu, all of Japan

[73] Assignee: Fuji Kagakushi Kogyo Co., Ltd., Osaka, Japan

[21] Appl. No.: 302,530

[22] Filed: Jan. 27, 1989

[30] Foreign Application Priority Data

Jan. 30, 1988 [JP] Japan ..... 63-20259
Jan. 30, 1988 [JP] Japan ..... 63-20260

[51] Int. Cl.[5] ..... B41M 5/26

[52] U.S. Cl. ..... 428/500; 204/2; 428/195; 428/412; 428/423.1; 428/424.2; 428/480; 428/483; 428/484; 428/920; 428/921

[58] Field of Search ..... 204/2; 428/195, 484, 428/488.1, 488.4, 913, 914, 412, 423.1, 424.2, 480, 483, 500, 920, 921

[56] References Cited

FOREIGN PATENT DOCUMENTS 217288 9/1986 Japan .

*Primary Examiner*—Pamela R. Schwartz
*Attorney, Agent, or Firm*—Armstrong, Nikaido, Marmelstein, Kubovcik & Murray

[57] ABSTRACT

A recording medium for electrothermal transfer printing comprising a base film, an adhesiveness improving layer provided on one surface of the base film, an electrically resistive layer provided on the adhesiveness improving layer, and a heat-sensitive transfer ink layer provided on the other surface of the base film, said electrically resistive layer comprising a binder comprising a polyvinyl butyral resin as a main component, an electrically conductive powder and an inorganic metallic compound type flame retardant. The content of an electrically conductive powder such as a conductive carbon in the resistive layer can be increased to reduce the electric resistance of the resistive layer and problems such as peeling of the resistive layer can be prevented, and a satisfactory flame resistance can be obtained without increasing the resistivity of the resistive layer. Thus, the electrothermal transfer printing can be conducted satisfactorily without any dangerousness.

4 Claims, No Drawings

RECORDING MEDIUM FOR ELECTROTHERMAL TRANSFER PRINTING

BACKGROUND OF THE INVENTION

The present invention relates to a recording medium for eletrothermal transfer printing, and more particularly to a recording medium used for an electrothermal transfer printing method wherein point electrodes for recording and current return electrodes are held in contact with a recording medium which is superposed on a receptor, a signal voltage is applied between both the electrodes to cause a current to pass through a portion of the recording medium, thereby generating heat in the portion to transfer a coloring component contained in the recording medium onto the receptor.

As such a recording medium for electrothermal transfer printing, there is known a recording medium wherein an electrically resistive layer is provided on one surface of an insulating base film, and a hot melt transfer ink layer is provided on the other surface of the base film. A polyester film is used as the base film, and a layer wherein an electrically conductive powder such as carbon black is dispersed in a binder such as a polyester resin is used as the resistive layer.

In the case of the above-mentioned conventional recording medium, however, the dispersibility of a conductive powder such as carbon black in the polyester resin is poor and accordingly the content of the powder cannot be increased (the upper limit of the content is at most about 30% by volume), so that the resistivity of the resistive layer cannot be lowered. For the reason, heretofore only a resistive layer having a high resistivity of not less than 2 kΩ/cm could be obtained.

When the resistivity of the resistive layer is too high, it is required to raise a voltage to be applied, which causes a problem relating to apparatus and another problem that when printed images with multigradation are desired, it is difficult to produce density gradations.

It has been found that the content of a conductive powder such as carbon black can be increased by using a polyvinyl butyral resin as the binder, thereby solving the above-mentioned problems. However, the polyvinyl butyral resin is poor in an adhesiveness to a base film such as polyester film, which causes a new problem that the resistive layer is easily peeled when point electrodes for recording are moved in a sliding contact with the resistive layer during electrothermal transfer printing.

Further, in the electrothermal transfer printing method, there is a dangerousness of fire since an electric current is passed through the recording medium to generate heat. Therefore, a flame resistance is required for the recording medium used for such a printing method as usually required for electronic parts.

However, since the above-mentioned conventional recording medium is poor in flame resistance, it cannot satisfy, for instance, UL-94HB standard.

It may be considered that a flame retardant is incorporated into the resistive layer. However, when a flame retardant such as phosphorus-containing retardant or halogen-containing retardant is added to the polyester resin used in the conventional resistive layer, the resistivity of the resistive layer is increased, which causes the above-mentioned problem.

It is an object of the present invention to provide a recording medium for electrothermal transfer printing in which the resistive layer has a low resistivity and is firmly adhered to the base film.

Another object of the present invention is to provide a recording medium for electrothermal transfer printing which is endowed with a good flame resistance without raising the electric resistivity of the firmly adhered resistive layer.

These and other objects of the present invention will become apparent from the descriptions hereinafter.

SUMMARY OF THE INVENTION

The present invention provides a recording medium for electrothermal transfer printing comprising a base film, an adhesiveness improving layer provided on one surface of the base film, an electrically resistive layer provided on the adhesiveness improving layer, and a heat-sensitive transfer ink layer provided on the other surface of the base film, and said electrically resistive layer comprising a binder comprising a polyvinyl butyral resin as a main component, an electrically conductive powder and an inorganic metallic compound type flame retardant.

DETAILED DESCRIPTION

In accordance with the present invention, the resistivity of the resistive layer can be lowered to a value of not more than 2 kΩ/cm since a good dispersed state of a conductive powder such as carbon black can be obtained even at a high content of the powder (for instance, from about 30% to 50% by volume) by using a polyvinyl butyral resin as the binder for the resistive layer. Moreover, problems such as peeling of the resistive layer during printing operation can be solved since the adhesiveness improving layer is interposed between the base film and the resistive layer.

Further, the recording medium of the present invention is endowed with a good flame resistance without raising the resistivity of the firmly adhered resistive layer by using an inorganic metallic compound type flame retardant.

The resistive layer of the recording medium of the present invention is a layer wherein a polyvinyl butyral resin is used as a binder and a conductive powder such as carbon black and an inorganic metallic compound type flame retardant are mixed with the binder.

As for the polyvinyl butyral resin, any usually available resins can be used without any limitation. However, those having a medium degree of polymerization or those having a high degree of polymerization are preferred since these are excellent in film forming property and in heat resistance.

One or more other resins such as styrene resins such as polystyrene, acrylic resins such as polymethyl methacrylate, and vinyl chloride resins such as polyvinyl chloride may be used in a small amount together with the polyvinyl butyral resin so long as the objects of the present invention are not spoiled.

As for the conductive powder, the so-called conductive carbon can be preferably used. Examples of the conductive carbon are, for instance, Vulcan XC-72R, Vulcan XC-72, Vulcan P, Black Pearls 2000 (these are available from Cabot Corp.) and Ketjenblack EC (available from AKZO N.V.).

In the present invention, the resistivity of resistive layer can be lowered to a value of about 1 kΩ/cm or less, since the content of a conductive powder such as conductive carbon in the resistive layer can be increased with keeping a good dispersed state of the powder by using the polyvinyl butyral resin as the binder.

The lower limit of the resistivity of the resistive layer is preferably about 0.5 kΩ/cm so as to avoid an excessively large amount of current density.

Accordingly, the resistivity of the resistive layer is preferably in the range of from 0.5 to 2 kΩ/cm, more preferably from 0.5 to 1 kΩ/cm.

In order to obtain the above-mentioned low resistivity, the content of the conductive powder in the resistive layer is preferably in the range of about 30 to 50% by volume.

The ratio of the above-mentioned polyvinyl buryral resin to the conductive powder is preferably in the range of 7:3 to 1:1 by volume. When the content of the conductive powder is more than the above-mentioned range, the resistivity of the resistive layer becomes too low and the adhesiveness of the resistive layer to the base film is reduced. When the content of the conductive powder is less than the above-mentioned range, the resistivity of the resistive layer becomes too high.

As for the above-mentioned inorganic metallic compound type flame retardant, antimony trioxide, magnesium hydroxide, and the like are exemplified. One or more other flame retardants including phosphorus-containing flame retardants and halogen-containing flame retardants, for instance, tetrabromobisphenol A, decabromodiphenyl oxide, halogen-containing organic condensed phosphoric acid esters, bromine-containing epoxy compounds, may be used in a small amount together with the inorganic metallic compound type flame retardant so long as the objects of the present invention are not spoiled.

The content of the flame retardant in the resistive layer is preferably in the range of about 10 to 30% by weight. When the content of the flame retardant is less than the above-mentioned range, the flame resistance is insufficient. When the content of the flame retardant is more than the above-mentioned range, properties of the resistive layer such as film property become poor.

In order to improve properties of the resistive layer such as heat resistivity, a cross-linking agent may be added to the polyvinyl butyral resin to cross-link it. Any cross-linking agent can be used without any limitation so long as the cross-linking agent can react with the hydroxyl group contained in the polyvinyl butyral resin. For instance, polyisocyanates can be used. Examples of the polyisocyanate are, for instance, tolylene diisocyanate and a reaction product of 3 moles of tolylene diisocyanate with 1 mole of trimethylolpropane.

The thickness of the resistive layer is preferably from about 1 to 5 μm in order to generate a desired amount of heat and to inhibit the thermal diffusion in the plane direction of the recording medium.

As for the base film, plastic films used for usual recording media for heat transfer printing can be used without any limitation. Examples of the plastic film are, for instance, polyester film, polypropylene the film, polycarbonate film, and the like. The thickness of the film is suitably in the range of 3 to 12 μm. Especially, a polyester film is most preferred from the viewpoint of its heat resistance, strength, etc.

In order to improve adhesiveness between the above-mentioned resistive layer and the base film, an under coating layer is provided between them as the above-mentioned adhesiveness improving layer. As for a main component of such an under coating layer, resins such as polyester resins (including unmodified polyester resins and modified polyester resins such as urethane-modified polyester resin), and polyurethane resins (including unmodified polyurethane resins and modified urethane resins such as silicone-modified urethane resin), coupling agents such as alkoxysilane, and the like can be used. Concrete examples thereof are, for instance, Vylon 50AS (polyester resin available from TOYOBO CO., LTD.), Vylon 29SS (polyester resin available from TOYOBO CO., LTD.), Espel 1520 (polyester resin available from Hitachi Chemical Co., Ltd.), PE-307 (polyester resin available from The Goodyear Tire & Rubber Co.), Sunpren TCM350 (polyurethane resin available from SANYO CHEMICAL INDUSTRIES, LTD.), SP-2200 (silicone-urethane resin), Si-coat 900A (alkoxysilane), PE-5833 (polyester resin), Pesresin S-230G (polyester resin available from Takamatsu Yushi Kabushiki Kaisha), and the like. When the base film is a polyester film, the above-mentioned under coating agents exhibit especially excellent effects for improving the adhesiveness.

The thickness of the under coating layer is preferably in the range of 0.2 to 0.6 g/m$^2$ from the viewpoint of the adhesiveness. Usually, the abovementioned resins are used preferably in a relatively thicker range (for instance, 0.4 to 0.6 g/m$^2$), and the above-mentioned coupling agent is used preferably in a relatively thinner range (for instance, 0.2 to 0.3 g/m$^2$).

A base film such as polyester film which is previously subjected to an adhesiveness improving treatment can be suitably used.

The above-mentioned adhesiveness improving treatment includes application of a primer layer of a product obtained by reacting (A) a component composed of a hydrophilic polyurethane resin and a hydrophilic acrylic resin, at least one of which has carboxyl group or salt thereof, with (B) a component composed of a hydrophilic epoxy resin. The above-mentioned carboxyl group or salt thereof in the component (A) is capable of reacting with the epoxy group in the component (B).

A hydrophilic polyurethane resin which is enhanced in its hydrophilic property by introducing carboxyl groups or salt thereof is preferably used. Such a hydrophilic property giving group is usually introduced in synthesis of the polyurethane resin or thereafter. The introduction of carboxyl groups or salt thereof is conducted in synthesizing the polyurethane resin, for instance, by the following methods: A carboxyl group containing polyhydroxy compound is used as at least one of polyhydroxy compounds as a starting material. Alternatively a polyurethane having unchanged isocyanate groups is used and the unchanged isocianate groups are reacted with a hydroxyl group containing carboxylic acid or an amino group containing carboxylic acid, and the reaction mixture is added to water or an aqueous alkaline solution with stirring at a high-speed, followed by neutralization. The amount of the introduced carboxyl group or salt thereof is preferably in the range of 0.1 to 15% by weight.

In order to improve the dispersibility of the resin to water, other groups than carboxyl group or salt thereof, such as sulfonic acid salt group and sulfuric acid half ester group, may be introduced.

Examples of the polyhydroxy compounds used for synthesizing the hydrophilic polyurethane resin are, for instance, polyethylene glycol, polypropylene glycol, polyethylene-propylene glycol, polytetramethylene glycol, hexamethylene glycol, tetramethylene glycol, 1,5-pentanediol, diethylene glycol, triethylene glycol, polycaprolactone, polyhexamethylene adipate, polyhexamethylene sebacate, polytetramethylene adipate, polytetramethylene sebacate, trimethylolpropane, trimethylolethane, pentaerythritol, and glycerin. Examples of the polyisocyanate compound are, for instance, hexamethylene diisocyanate, diphenylmethane diisocyanate, tolylene diisocyanate, isopherone diisocyanate, addition product of tolylene diisocyanate and trimethylolpropane, and addition product of hexamethylene diisocyanate and trimethylolethane. Examples of the carboxyl group containing polyol are, for instance, dimethylolpropionic acid, dimethylolbutyric acid, dimethylolvaleric acid, and bis(ethylene glycol) trimellitate. Examples of the amino group containing carboxylic acid are, for instance, $\beta$-aminopropionic acid, $\gamma$-aminobutyric acid, p-aminobenzoic acid. Examples of the hydroxyl group containing carboxylic acid are, for instance, 3-hydroxypropionic acid, $\gamma$-hydroxybutyric acid, p-(2-hydroxyethyl)benzoic acid, and malic acid.

The synthesis of the hydrophilic polyurethane resin using these compounds can be carried out by means of conventionally known methods. Such a hydrophilic polyurethane resin is used in the form of a stable aqueous dispersion or an aqueous solution which is prepared by using a suitable dispersing agent, if necessary.

As the hydrophilic acrylic resin, those having carboxyl groups or salt thereof are preferably used. Such a hydrophilic property giving group is introduced by using a monomer having a carboxyl group or salt thereof as one of monomers for acrylic resin. For instance, the carboxyl group can be introduced by copolymerizing one or more kinds of carboxyl group containing monomers such as acrylic acid, methacrylic acid, crotonic acid, itaconic acid, maleic acid and fumaric acid, or one or more kinds of alkyl monoesters of copolymerizable carboxylic acids such as itaconic acid, maleic acid and fumaric acid, with other vinyl compounds. The carboxylic acid salt group can be introduced, for instance, by copolymerizing a metallic salt, ammonium salt or tertiary amine salt of the above-mentioned monomer, or by neutralizing the above-mentioned resins or a maleic anhydride containing copolymer or an itaconic anhydride containing copolymer by means of an aqueous alkaline solution after the synthesis thereof. The amount of the introduced carboxyl group or salt thereof is preferably in the range of 0.1 to 15% by weight.

Examples of the other vinyl monomer copolymerizable with the above-mentioned monomers are, for instance, alkyl (or aryl) acrylates or alkyl (or aryl) methacrylates (as for the alkyl group and aryl group, methyl, ethyl, n-propyl, isopropyl, n-butyl, isobutyl, t-butyl, 2-ethylhexyl, cyclohexyl, phenyl, benzyl, and phenylethyl are exemplified); hydroxyl group containing monomers such as 2-hydroxyethyl acrylate, 2-hydroxyethyl methacrylate, 2-hydroxypropyl acrylate, and 2-hydroxypropyl methacrylate; amido group containing monomers such as acrylamide, methacrylamide, N-methylmethacrylamide, N-methylacrylamide, N-methylolacrylamide, N,N-dimethylolacrylamide, N-methylolmethacrylamide, N-methoxymethylacrylamide, N-methoxymethylmethacrylamide, and N-phenylacrylamide; amino group containing monomers such as N,N-diethylaminoethyl acrylate and N,N-diethylaminoethyl methacrylate; epoxy group containing monomers such as glycidyl acrylate, glycidyl methacrylate and allyl glycidyl ether; monomers having sulfonic acid group or sulfonate group such as styrenesulfonic acid and vinylsulfonic acid or salts thereof (sodium salt, potassium salt, ammonium salt, and the like); vinyl isocyanate, allyl isocyanate, styrene, vinyl methyl ether, vinyl ethyl ether, vinyl(trisalkoxy)silane, acrylonitrile, methacrylonitrile, vinylidene chloride, vinyl acetate, vinyl chloride, and the like.

The ratio of the hydrophilic polyurethane resin to the hydrophilic acrylic resin is preferably in the range of 10:1 to 1:10 by weight, more especially 10:1 to 1:1 by weight, most especially 4:1 to 1.1:1 by weight. The amount of the carboxyl group or salt thereof introduced in the hydrophilic polyurethane resin and/or the hydrophilic acrylic resin is preferably in the range of 0.1 to 15% by weight, more preferably 0.1 to 5% by weight, per the total amount of both resins.

As for the above-mentioned carboxyl group or salt thereof, a carboxyl group or its amine salt group is the most preferable one from the viewpoint of the reactivity of cross-linking with an epoxy group.

As for the hydrophilic epoxy resin as the component (B) to be reacted with the above-mentioned component (A), epoxy resins having two or more epoxy groups are preferably used. Examples of the epoxy compounds are those soluble or dispersible in water as described below:

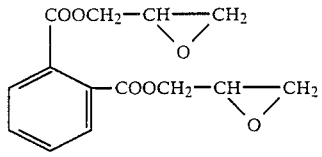

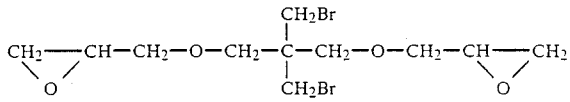

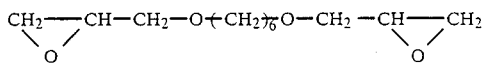

-continued
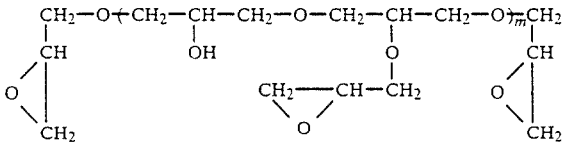
(m = 1 to 3)
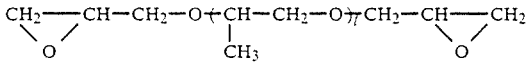
(l = 1 to 13)
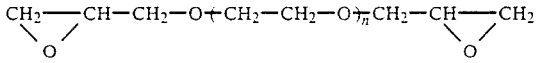
(n = 1 to 13)
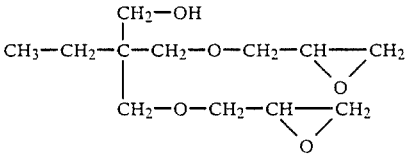
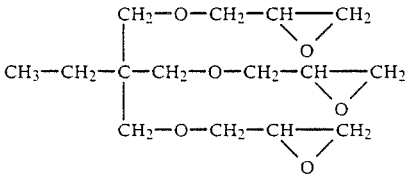
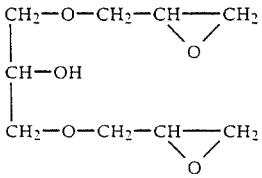
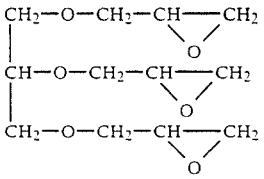
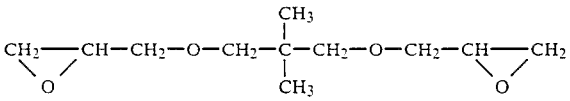
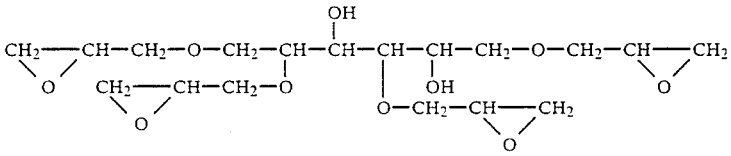
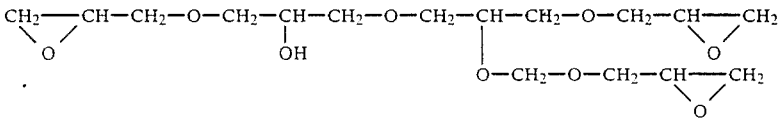
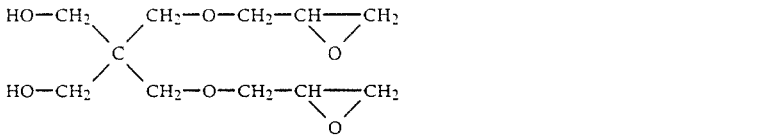

-continued

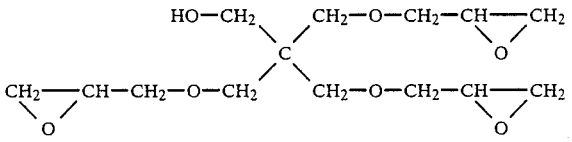

and addition condensation product of bisphenol A with epichlorohydrin.

An aqueous primer composition composed of the above-mentioned component (A) and component (B) may be used in the form of either aqueous solution or aqueous dispersion. The proportion of the component (A) and the component (B) in the primer composition is preferably selected in such a manner that the amount of the component (B) is in the range of 1 to 40% by weight based on the total solid content of both the components (A) and (B).

As for the heat-sensitive transfer ink layer of the present invention, any conventional one such as hot melt transfer type or sublimation transfer type can be used. In the case of the hot melt transfer type ink layer, an ink layer composed of one or more waxes and/or one or more resins as the main component of the vehicle and one or more of various pigments or dyes as the coloring agent is suitably used. An ink layer of single color may be provided over the entire surface of a base film. Further, plural ink layers of different colors (for instance, yellow, cyan, magenta, etc.) may be disposed side by side on the same base film. The coating amount of the ink layer is preferably in the range of 0.5 to 10 g/m$^2$.

A recording medium having a structure wherein a base film having a conductive layer (having a very low resistivity) such as vacuum deposited metallic layer provided on one surface thereof is used, and the above-mentioned under coating layer and the resistive layer are provided on the surface of the conductive layer in that order, can be adopted.

PREFERRED EMBODIMENTS

The present invention is more specifically described and explained by means of the following Examples. It is to be understood that the present invention is not limited to the Examples, and various change and modifications may be made in the invention without departing from the spirit and scope thereof.

EXAMPLES 1 TO 14

Each under coating agent shown in Table 1 was applied onto one surface of a polyethylene terephthalate film having a thickness of 3.5 μm, followed by drying to form an under coating layer. A coating composition prepared by dissolving or dispersing 35 parts by weight of a polyvinyl butyral resin (available from Sekisui Chemical Co., Ltd. under the commercial name "S-Lec BH-3", high degree of polymerization type, butyral group content: 65±3% by mole, acetyl group content: not more than 3% by mole), 35 parts by weight of a conductive carbon (available under the commercial name "Ketjenblack EC"), 25 parts by weight of antimony trioxide (available from AJINOMOTO CO., INC. under the commercial name "Polysafe 60") and 5 parts by weight of polyisocyanate (available from Nippon Poriuretan Kogyo Kabushiki Kaisha under the commercial name "Coronate HL") into a suitable amount of a solvent such as toluene was applied onto the above-mentioned under coating layer. After the solvent was volatilized, the coating was dried by heating at 90° C. for 10 seconds to form a resistive layer having a coating weight after being dried of 2.4 g/m$^2$ and a content of the conductive carbon of about 40% by volume. Then, an ink having a melting temperature of 80° C. and containing a wax, a resin and carbon black as the main component was applied by hot melt coating onto the opposite surface of the above-mentioned base film to form a hot melt transfer ink layer having a thickness of 2 μm. 14 kinds of recording media for electrothermal transfer printing were obtained.

COMPARATIVE EXAMPLES 1 AND 2

The same procedures as in Example 1 except that the resistive layer was formed directly onto the polyethylene terephthalate film as it was (Comparative Example 1) or directly onto the polyethylene terephthalate film which had been aged at 50° C. for 12 hours (Comparative Example 2) were repeated to obtain two kinds of recording media for electrothermal transfer printing.

Measurement

With respect to each of the obtained recording media, the electric resistivity (kΩ/cm) and adhesive property of the resistive layer and the flame resistance (provided in UL-94HB standard) were determined.

The electric resistivity was measured by using a resistivity measuring device available under the commercial name "Loresta FP" from MITSUBISHI PETROCHEMICAL COMPANY, LTD.).

The adhesive property was determined by a peeling test using a pressure sensitive adhesive tape as follows:

(1) Measuring method A pressure sensitive adhesive tape (available from SUMITOMO 3M LIMITED under the commercial name "Scotch-mending-tape 810") was pressed to be adhered onto the resistive layer.

Area of the adhesive tape adhered to the resistive layer: more than 18 mm×50 mm

Adhering condition: pressing 5 times by means of Roller No. 1 made by Ito-shoji Kabushiki Kaisha After a tension gauge was attached to the reinforced part of the adhesive tape, the tape was peeled in the specified direction at a rate of about 2 cm/second. The ratio of the area of the resistive layer peeled off with the adhesive tape to the area of the adhesive tape initially adhered to the resistive layer (hereinafter referred to as "initially adhered area") was determined.

(2) Evaluation criteria

The criteria of evaluation for the adhesive property were as follows:

1: The resistive layer was peeled almost completely.
2: The area of the resistive layer peeled was more than half of the initially adhered area.
3: The area of the resistive layer peeled was not more than half of the initially adhered area.
4: The resistive layer was peeled to some extent.
5: The resistive layer was scarcely peeled.
6: The resistive layer was not peeled at all.

There is no problem for practical purposes, when the area of the resistive layer peeled is not more than half of the initially adhered area in the abovementioned peeling test. The results are shown in Table 1.

TABLE 1

| Ex. No. | Under coating layer Material* | Coating weight ($g/m^2$) | Resistivity (kΩ/cm) | Adhesive property | Flame resistance (UL-24HB) |
|---|---|---|---|---|---|
| 1 | Vylon 50AS | 0.25 | 0.63 | 3 | pass |
| 2 | Vylon 29SS | 0.25 | 0.64 | 3 | pass |
| 3 | Vylon 29SS | 0.55 | 0.59 | 6 | pass |
| 4 | Espel 1520 | 0.25 | 0.65 | 6 | pass |
| 5 | Espel 1520 | 0.55 | 0.60 | 6 | pass |
| 6 | PE-307 | 0.25 | 0.58 | 3 | pass |
| 7 | PE-307 | 0.55 | 1.05 | 5 | pass |
| 8 | Sunpren TCM350 | 0.25 | 0.58 | 3 | pass |
| 9 | SP-2200 | 0.55 | 0.78 | 5 | pass |
| 10 | Si-coat 900A | 0.25 | 0.61 | 4 | pass |
| 11 | PE-5833 | 0.25 | 0.65 | 3 | pass |
| 12 | Pesresin S-230G | 0.25 | 0.57 | 3 | pass |
| 13 | Pesresin S-230G | 0.55 | 1.27 | 5 | pass |
| 14 | CSP | — | 0.62 | 4 | pass |
| Com. Ex. 1 | — | — | 0.62 | 1 | pass |
| Com. Ex. 2 | — | — | 0.62 | 2 | pass |

*Vylon 50AS: Polyester resin available from TOYOBO CO., LTD.
Vylon 29SS: Polyester resin available from TOYOBO CO., LTD.
Espel 1520: Polyester resin available from Hitachi Chemical Co., Ltd.
PE-307: Polyester resin available from The Goodyear Tire & Rubber Co.
Sunpren TCM350: Polyurethane resin available from SANYO CHEMICAL INDUSTRIES, LTD.
SP-2200: Silicone-modified polyurethane resin
Si-coat 900A: Alkoxysilane
PE-5833: Polyester resin
Pesresin S-230G: Polyester resin available from Takamatsu Yushi Kabushiki Kaisha
CPS: A polyester film wherein one surface thereof is subjected to an adhesiveness improving treatment, available from Teijin Limited. In this case, the resistive layer was formed directly on the adhesiveness improved surface of the polyester film.

When a polyvinyl butyral resin available from Sekisui Chemical Co., Ltd. under the commercial name "S-Lec BM-S" (medium degree of polymerization type, butyral group content: not less than 70% by mole, acetyl group content: 4 to 6% by mole) was used instead of the polyvinyl butyral resin used in Examples 1 to 14, the same excellent results as in Examples 1 to 14 were obtained.

EXAMPLE 15

The same procedures as in Example 14 except that magnesium hydroxide (available from Kyowa Chemical Industries Co, Ltd. under the commercial name "Kisuma 5B") was used instead of antimony trioxide were repeated to obtain a recording medium for electrothermal transfer printing.

With respect to the obtained recording medium, resistivity (kΩ/cm) and adhesive property of the resistive layer and the flame resistance (provided in UL-94HB) were determined.

The results are as follows:

Resistivity: 0.65 kΩ/cm
Adhesive property: 4
Flame resistance: pass

In addition to the materials and ingredients used in the Examples, other materials and ingredients can be used in the Examples as set forth in the specification to obtain substantially the same results.

In the present invention, a polyvinyl butyral resin was employed as the binder for the electrically resistive layer and an adhesiveness improving layer is interposed between the base film and the resistive layer, whereby the content of an electrically conductive powder such as a conductive carbon in the resistive layer can be increased to reduce the electric resistance of the resistive layer and there occur no problems such as peeling of the resistive layer. Further, the recording medium for electrothermal transfer printing of the present invention is endowed with a good flame resistance without increasing the resistivity of the resistive layer by using an inorganic metal compound type flame retardant. Thus, the electrothermal transfer printing can be conducted satisfactorily to give clear printed images without any dangerousness.

What is claimed is:

1. A recording medium for electrothermal transfer printing comprising a base film, an adhesiveness improving layer provided on one surface of the base film, an electrically resistive layer provided on the adhesiveness improving layer, and a heat-sensitive transfer ink layer provided on the other surface of the base film, said electrically resistive layer comprising a binder comprising a polyvinyl butyral resin as a main component, an electrically conductive powder and an inorganic metallic compound flame retardant.

2. The recording medium of claim 1 wherein said adhesiveness improving layer comprises at least one resin selected from the group consisting of a polyester resin and a polyurethane resin and has a coating weight of 0.2 to 0.6 $g/m^2$.

3. The recording medium of claim 1, wherein said adhesiveness improving layer is a layer formed from an aqueous resin composition comprising (A) a hydrophilic polyurethane resin and a hydrophilic acrylic resin, and (B) a hydrophilic epoxy resin, wherein the proportion of the component (B) is from 1 to 40% by weight based on the total solid content of both components (A) and (B).

4. The recording medium of claim 1, wherein said flame retardant is at least one compound selected from the group consisting of antimony trioxide and magnesium hydroxide.

* * * * *